US007693462B2

(12) United States Patent
Hori et al.

(10) Patent No.: US 7,693,462 B2
(45) Date of Patent: Apr. 6, 2010

(54) PROCESS CARTRIDGE AND IMAGE FORMING APPARATUS USING IMAGE DEVELOPER PROVIDING REDUCED TONER COHESION

(75) Inventors: Eisuke Hori, Tokyo (JP); Hideki Kimura, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 62 days.

(21) Appl. No.: 12/015,787

(22) Filed: Jan. 17, 2008

(65) Prior Publication Data

US 2008/0205937 A1 Aug. 28, 2008

(30) Foreign Application Priority Data

Feb. 23, 2007 (JP) ..... 2007-043421

(51) Int. Cl.
*G03G 15/08* (2006.01)

(52) U.S. Cl. ..... 399/256

(58) Field of Classification Search ..... 399/254, 399/272, 274, 281, 284, 256
See application file for complete search history.

(56) References Cited

U.S. PATENT DOCUMENTS

| | | | |
|---|---|---|---|
| 6,505,026 | B2 | 1/2003 | Hayakawa et al. |
| 6,826,381 | B2 | 11/2004 | Muramatsu et al. |
| 7,043,182 | B2 | 5/2006 | Sakai et al. |
| 7,212,773 | B2 | 5/2007 | Sudo et al |
| 7,228,093 | B2 | 6/2007 | Sakai et al. |
| 7,272,342 | B2 | 9/2007 | Nagashima et al. |
| 2005/0031374 | A1 | 2/2005 | Nagashima et al. |
| 2005/0116997 | A1 | 6/2005 | Katoh et al. |
| 2006/0029435 | A1 | 2/2006 | Kasai et al. |
| 2006/0067727 | A1 * | 3/2006 | Suda et al. ..... 399/100 |
| 2006/0188273 | A1 * | 8/2006 | Takesawa et al. ..... 399/27 |
| 2007/0104516 | A1 | 5/2007 | Katoh et al. |

FOREIGN PATENT DOCUMENTS

| | | | |
|---|---|---|---|
| JP | 06214458 | A * | 8/1994 |
| JP | 2001-194883 | | 7/2001 |
| JP | 3320954 | | 6/2002 |
| JP | 2003-5487 | | 1/2003 |
| JP | 2004151542 | A * | 5/2004 |
| WO | WO 03/066336 | A1 | 8/2003 |

OTHER PUBLICATIONS

U.S. Appl. No. 12/188,549, filed Aug. 8, 2008, Hori, et al.
U.S. Appl. No. 11/718,293, filed Aug. 2, 2007, Akiko Bannai et al.

* cited by examiner

*Primary Examiner*—Quana M Grainger
(74) *Attorney, Agent, or Firm*—Oblon, Spivak, McClelland, Maier & Neustadt, L.L.P.

(57) ABSTRACT

An image developer, including a rotatable developer bearer; a rotatable developer feeding member contacting the developer bearer; a developer container located above the developer feeding member, wherein the developer container includes a pressure reducing member configured to reduce a pressure applied to the developer feeding member; and a first stirring bar located directly below the pressure reducing member and configured to stir a developer such that a gap between an end of the pressure reducing member and an outer diameter of the stirring bar is 6 mm.

17 Claims, 6 Drawing Sheets

PROCESS CARTRIDGE AND IMAGE FORMING APPARATUS USING IMAGE DEVELOPER PROVIDING REDUCED TONER COHESION

BACKGROUND OF THE INVENTION

1. Field of the Invention

The present invention relates to a an image developer, a process cartridge and an image forming apparatus for electrophotographic image forming processes in copiers, facsimiles, printers, etc.

2. Discussion of the Background

Conventionally, as disclosed in Japanese Patent No. 3320954, one-component image developer has been known, in which a non-magnetic or a magnetic toner (developer) included in a container is fed to a developing roller (developer bearer) with a toner feeding member (roller) formed of a foamed polyurethane, etc., an elastic member such as a metallic thin plate is pressed to the developing roller (developer bearer) to uniform a toner thereon, and an electrostatic latent image formed on a photoreceptor (image bearer) is developed with toner.

Recently, in compliance with color-oriented demands at offices, full-color image forming apparatuses appear. One of the full-color image forming apparatuses is a photoreceptor-of-four tandem image forming apparatus including four image forming units in which a yellow toner image, a magenta toner image, a cyan toner image and a black toner image are formed on each 4 photoreceptors with a powdery one-component developer (toner), and the images are sequentially transferred onto a receiving material to form a full-color image thereon.

However, the image developer in which a developer charging and layer forming part and a developer storing part are located in parallel as disclosed in Japanese Patent No. 3320954 is difficult to downsize, and particularly the full-color image forming apparatus having plural image forming units are more difficult to downsize.

As one of the methods of downsizing the image developer, the developer storing part is located above the developer charging and layer forming part, i.e., the image developer becomes vertically long. The developer is fed in the direction of gravitational force and an intake capacity of the developer varies a feeding amount thereof and it is difficult to stably feed the developer, resulting in foggy images due to an excessive uncharged developer and defective images such as image density variation.

Further, the toner has smaller particle diameter recently in order to produce high-quality images has higher cohesion. When the apparatus is not used or left for a while, the developer in the image developer agglutinates due to gravity and only the toner very close to the feeding roller and developing roller is used, resulting in image density deterioration and hazy images due to poor feeding of the toner.

Constantly stirring the whole toner in the image developer is considered to prevent the toner cohesion due to gravity. However, the toner is difficult to transfer up and down in the vertically long image developer, the toner is unnecessarily stressed and deterioration thereof is accelerated, and the toner circulation close to the feeding roller deteriorates occasionally depending on the stirring direction.

Japanese Published Unexamined Patent Application No. 2003-5487 divides the vertically long image developer into the above and below, detects a toner amount of the below and controls a rotation of a toner feeding member such that the toner is difficult to pressurize the feeding roller neighborhood. However, 4 sets of parts such as a toner amount detector (sensor) and an electromagnetic clutch controlling the rotation of the toner feeding member are required, resulting in complicated apparatus and cost increase.

Japanese Published Unexamined Patent Application No. 2001-194883 discloses means of reducing toner stress by reducing stress to the developing roller, doctor blade and feeding roller. However, stress is directly applied thereto unchangeably and the developer having a small particle diameter and low-temperature fixability is not affected thereby. Under an environment of high temperature and high humidity, image density deterioration and hazy images due to deterioration of fluidity are inevitable.

Because of these reasons, a need exists for a downsized image developer longitudinally having a developer container above a developer charging and layer forming part thereof, capable of stably feeding a developer to the developer charging and layer forming part to develop quality images.

SUMMARY OF THE INVENTION

Accordingly, an object of the present invention is to provide a downsized image developer longitudinally having a developer container above a developer charging and layer forming part thereof, capable of stably feeding a developer to the developer charging and layer forming part to develop quality images.

Another object of the present invention is to provide a process cartridge using the image developer.

A further object of the present invention is to provide an image forming apparatus using the image developer.

These objects and other objects of the present invention, either individually or collectively, have been satisfied by the discovery of an image developer, comprising:

a rotatable developer bearer;

a rotatable developer feeding member contacting the developer bearer;

a developer container located above the developer feeding member, wherein the developer container comprises:

a pressure reducing member configured to reduce a pressure applied to the developer feeding member;

a stirring bar configured to stir a developer; and a gap of 6 mm between an end of the pressure reducing member and an outer diameter of the stirring bar.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a downsized image developer longitudinally having a developer container above a developer charging and layer forming part thereof, capable of stably feeding a developer to the developer charging and layer forming part to develop quality images.

More particularly, the present invention relates to an image developer, comprising:

a rotatable developer bearer;

a rotatable developer feeding member contacting the developer bearer;

a developer container located above the developer feeding member, wherein the developer container comprises:

a pressure reducing member configured to reduce a pressure applied to the developer feeding member;

a stirring bar configured to stir a developer; and a gap of 6 mm between an end of the pressure reducing member and an outer diameter of the stirring bar.

Figure 1:
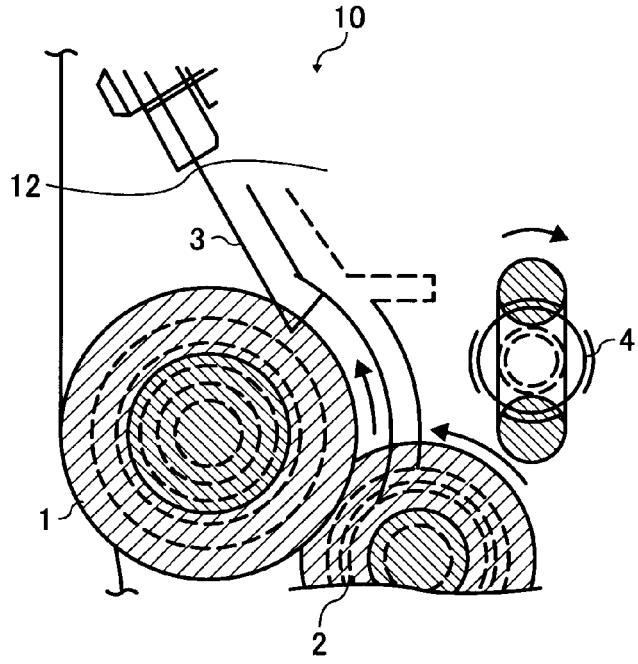
FIG. 1 is schematic view illustrating a toner flow in an image developer.

FIG. 1 is schematic view illustrating a toner flow in an image developer. The toner flows along the rotations of each rotator as shown in FIG. 1. The toner scraped by a doctor blade 3 flows downstream, pushed out from the upstream side without a rotator close thereto. It is preferable that a pressure from above to a doctor nip is avoided as much as possible because the doctor nip is particularly likely to have a toner cohesion.

Figure 2:
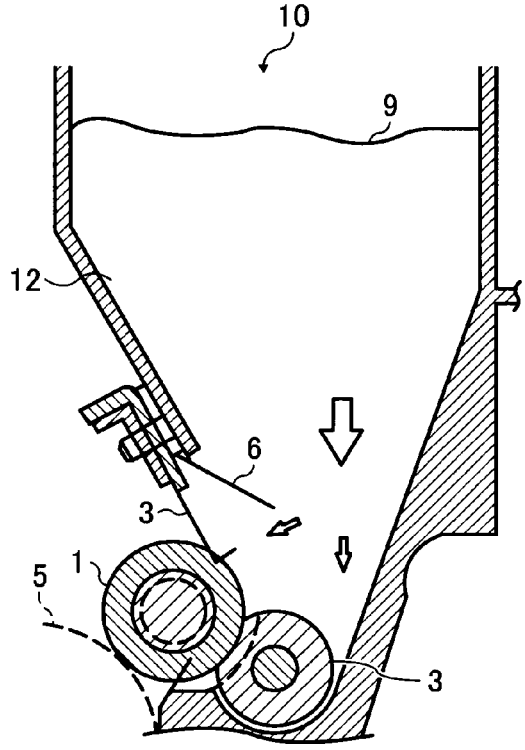
FIG. 2 is a schematic view for explaining an operation of a pressure reliever in an embodiment of the image developer of the present invention.

FIG. 2 is a schematic view for explaining an operation of a pressure reliever in the image developer of the present invention. A doctor blade nip has at least a pressure relieving plate 6 above as a pressure reducing member. Without a stirring bar 4, a toner pressure is applied at an angle from a slit of the pressure relieving plate 6 as shown in FIG. 2, the pressure relieving plate 6 less effectively works. In the present invention, a distance between a tip of the pressure relieving plate 6 and an outer diameter of the stirring bar 4 (hereinafter referred to as a first stirring bar) is from 1 to 6 mm, and a toner pressure applied at angle from an area just below the pressure relieving plate 6 is reduced. Therefore, the toner flow by the first stirring bar 4 is not interfered and the toner cohesion does not occur near the doctor blade nip.

Figure 3:
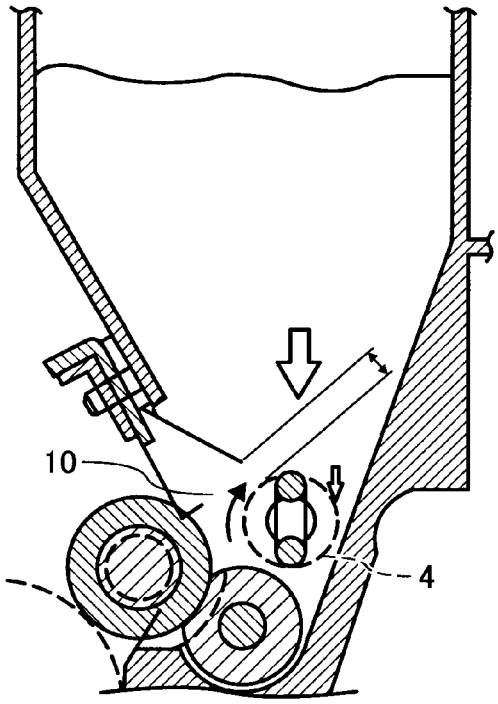
FIG. 3 is a schematic view for explaining a positional relationship between a tip of the pressure relieving plate and an outer diameter of the first stirring bar in the present invention.

FIG. 3 is a schematic view for explaining a positional relationship between a tip of the pressure relieving plate and an outer diameter of the first stirring bar in the present invention. As shown in FIG. 3, a distance between a tip of the pressure relieving plate 6 and an outer diameter of the first stirring bar 4 is specified as 6 mm or less. The longer the distance, the less the effect of the first stirring bar 4, resulting in inability to reduce the toner pressure at an angle. When the image developer is not so much filled with the toner, the toner pressure is not so high and the distance does not matter much. However, the image developer is fully filled with the toner recently and a distance between a tip of the pressure relieving plate 6 and an outer diameter of the first stirring bar 4 is specified as 6 mm or less in the present invention. Therefore, even when the image developer is fully filled with the toner, the toner pressure at an angle from the neighborhood of the exit of the pressure relieving plate 6 can be reduced.

The first stirring bar 4 prevents the toner cohesion, and accelerates the toner cohesion if it has transfer capability. Therefore, the first stirring bar 4 has such a shape as not to have transfer capability.

Figure 4:
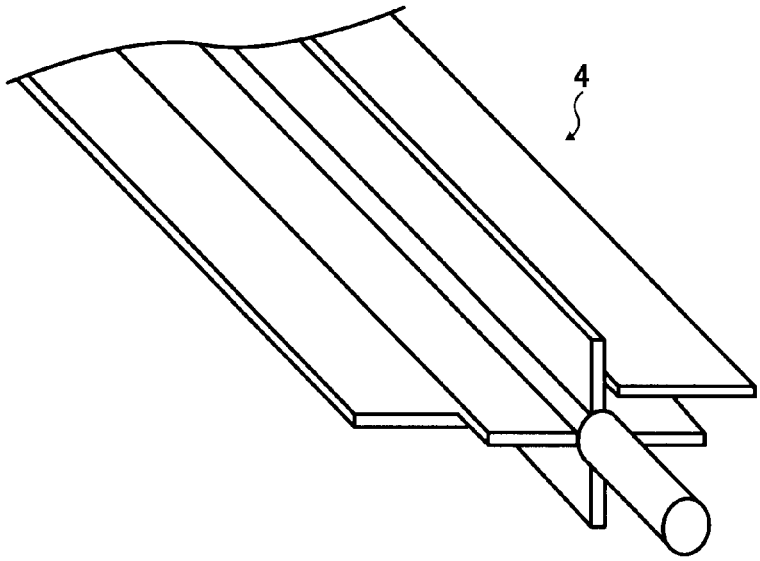
FIG. 4 is a schematic view illustrating a stirring bar in a conventional image developer.

FIG. 4 is a schematic view illustrating a stirring bar in a conventional image developer. As shown in FIG. 4, when the first stirring bar 4 is formed of a flat plate, a transfer force generates in tangential direction of the rotation thereof. Therefore, the first stirring bar 4 has a shape widening toward a downstream side thereof in the rotating direction so as to be incapable of transferring the toner close thereto, and rotates to flow the toner so as not to generate a toner cohesion.

Figure 5:
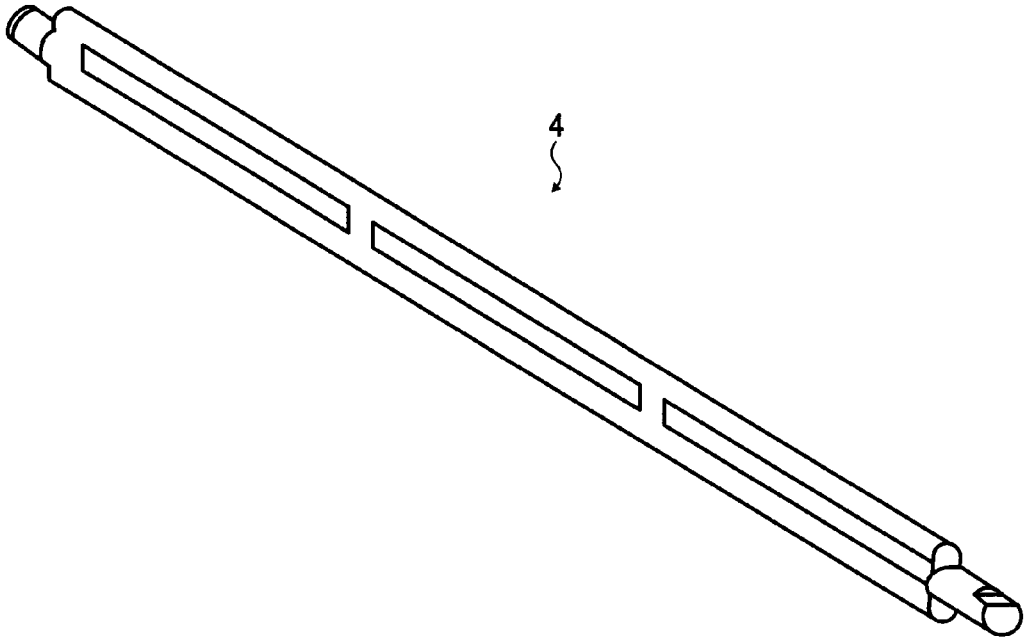
FIG. 5 is a schematic view illustrating an embodiment of the first stirring bar in the image developer of the present invention.
Figure 6:
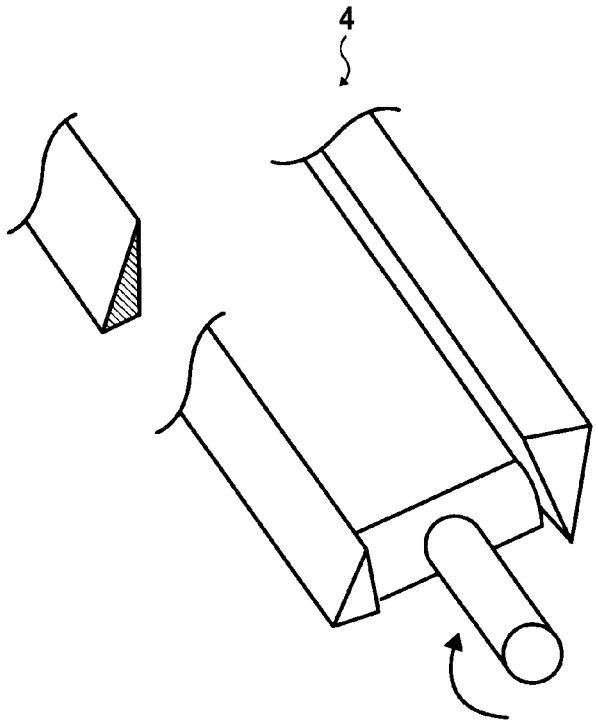
FIG. 6 is a schematic view illustrating another embodiment of the first stirring bar in the image developer of the present invention.
Figure 7:
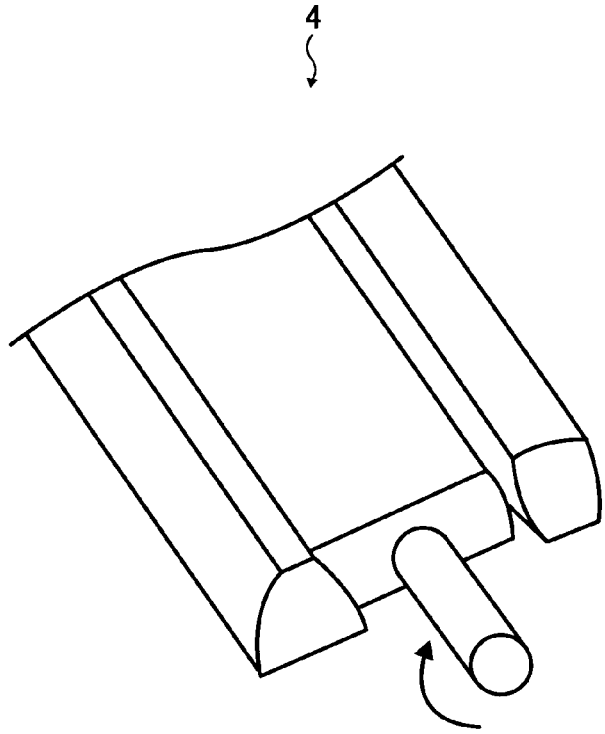
FIG. 7 is a schematic view illustrating a further embodiment of the first stirring bar in the image developer of the present invention.

FIG. 5 is a schematic view illustrating an embodiment of the first stirring bar in the image developer of the present invention. As shown in FIG. 5, the first stirring bar 4 having the shape of a cylinder is almost incapable of transferring the toner close thereto. The first stirring bar 4 rotates to flow the toner so as not to generate a toner cohesion. FIG. 6 is a schematic view illustrating another embodiment of the first stirring bar in the image developer of the present invention, and FIG. 7 is a schematic view illustrating a further embodiment of the first stirring bar in the image developer of the present invention. The first stirring bar 4 may have a cross-section having the shape of a triangle or a quadrangle as shown in FIG. 6 or 7. The first stirring bar 4 has a shape widening toward a downstream side thereof in the rotating direction so as to be incapable of transferring the toner close thereto, and rotates to flow the toner so as not to generate a toner cohesion.

Figure 8:
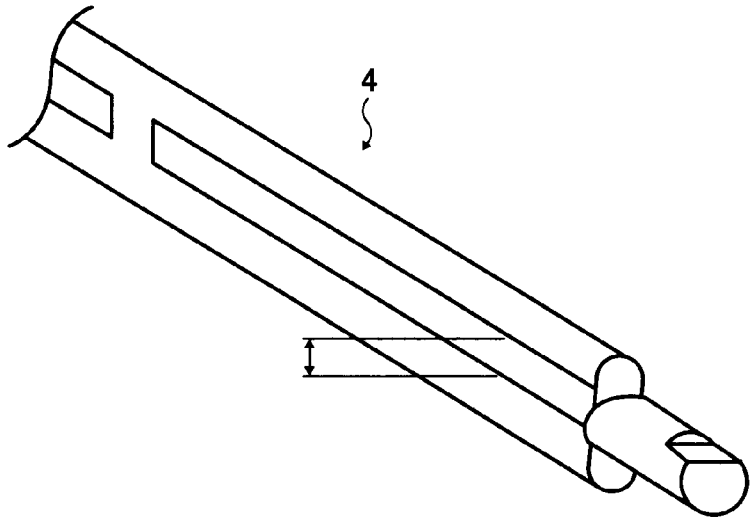
FIG. 8 is a schematic view illustrating another embodiment of the first stirring bar in the image developer of the present invention.

FIG. 8 is a schematic view illustrating another embodiment of the first stirring bar in the image developer of the present invention. When the first stirring bar 4 is formed of two cylinders having a narrow gap therebetween, the cylinders have a toner cohesion therebetween and the first stirring bar 4 occasionally becomes a flat plate. When the first stirring bar 4 has the shape of a plate, the toner is forced out in tangential direction of the rotation thereof, resulting in an occasional toner cohesion. In FIG. 8, the gap is not less than 2 mm so as not to have a toner cohesion. Therefore, the first stirring bar 4 does not have a large transfer force.

One-component developing methods include many friction parts, and deterioration of a toner passing the friction parts is accelerated. A thin layer is formed uniformly on a developing roller 1 constantly. However, when an image having a low image area, most of the thin layers uniformly formed on the developing roller 1 are collected in the image developer 10. When the collected toner is fed again soon, the deterioration of the toner is further accelerated, and therefore the collected toner is preferably mixed with a brand-new toner. As shown in FIG. 1, when the doctor blade 3 forms a thin layer, an unnecessary toner is scraped and returned upstream along a bent end of the doctor blade 3. When the first stirring bar 4 rotates in the reverse direction thereof, the scraped toner is directly fed to the feed roller 3 again. However, in FIG. 1, the first stirring bar 4 rotates in the forward direction of the flow of the scraped toner. Then, the scraped toner is retuned upstream to be stirred again with a bran-new toner.

Figure 9:
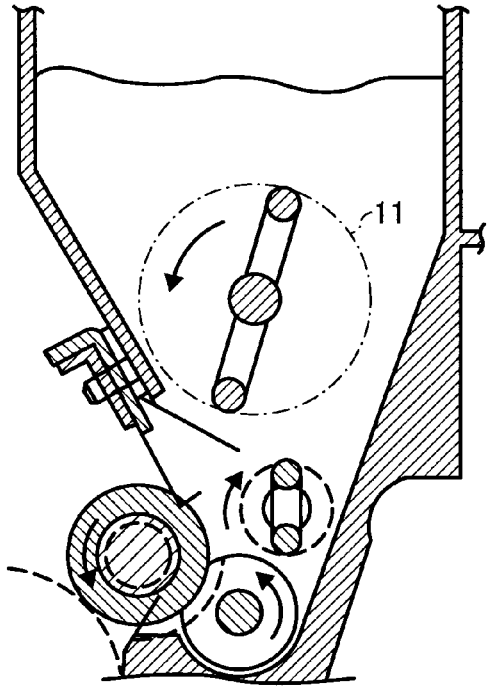
FIG. 9 is a schematic view illustrating another embodiment of the image developer of the present invention.

FIG. 9 is a schematic view illustrating another embodiment of the image developer of the present invention. Even in a vertically-long developer container 12 formed above, a toner agglutinates and does not fall down when the image developer is not used for a long time or left in an environment of high temperature and high humidity. In order to use the toner without waste, a stirring bar 11 (hereinafter referred to as "a second stirring bar") is located in the developer container 12 in many cases. If the stirring bar 11 had capability of transferring the toner downward, a toner cohesion would be accelerated. Therefore, the second stirring bar 11 has a shape widening toward a downstream side thereof in the rotating direction so as to be incapable of transferring the toner close thereto, and rotates to flow the toner so as not to generate a toner cohesion.

The second stirring bar 11 may have a cross-section having the shape of a triangle or a quadrangle.

Figure 10:
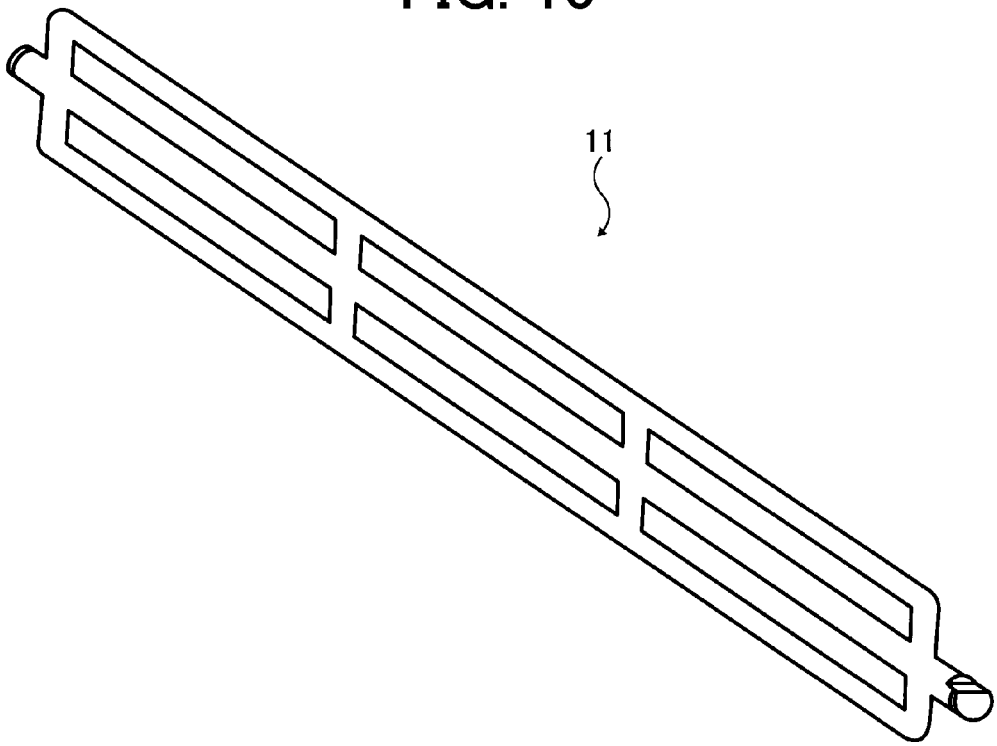
FIG. 10 is a schematic view illustrating an embodiment of the second stirring bar in the image developer of the present invention.
Figure 11:
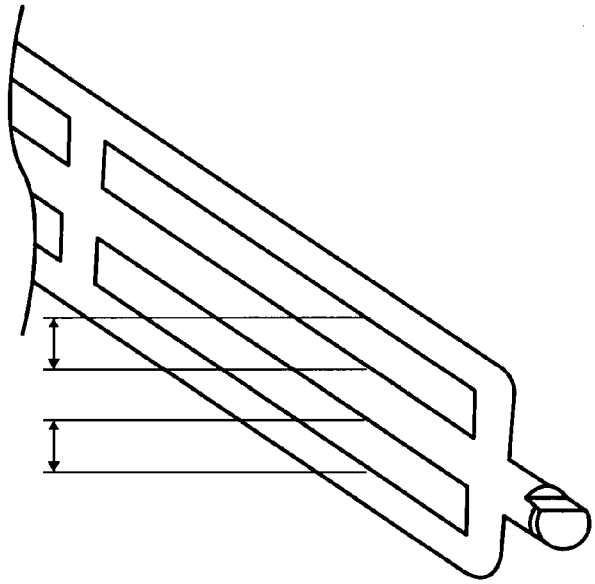
FIG. 11 is a schematic view illustrating another embodiment of the second stirring bar in the image developer of the present invention.

FIG. 10 is a schematic view illustrating an embodiment of the second stirring bar in the image developer of the present invention. FIG. 11 is a schematic view illustrating another embodiment of the second stirring bar in the image developer of the present invention.

The second stirring bar 11 may have the shape of a cylinder and may be plural. Therefore, the second stirring bar 11 is incapable of transferring the toner close thereto, and rotates to flow the toner so as not to generate a toner cohesion.

When a toner cohesion generated on the doctor blade nip pushes up the doctor blade 3, a thin layer on the developing roller 1 becomes thicker than desired. In a process cartridge including an image developer 10 and at least a photoreceptor drum 5, a toner layer transferred from the developing roller 1 to the photoreceptor drum 5 also becomes thicker than desired. When a toner cohesion generates close to the feeding roller 3, the toner is insufficiently fed for images having a large image area and a toner layer on the drum becomes thin. The process cartridge having the above-mentioned image developer preventing a toner cohesion can stably produce high-quality images for long periods.

Next, a toner for use in the present invention will be explained.

The toner preferably has a weight-average particle diameter (D4) of from 3 to 8 μm in order to reproduce a microscopic dot not less than 600 dpi. When less than 3 μm, the transferability of the toner and blade cleanability deteriorate. When greater than 8 μm, it is difficult to prevent the toner from scattering.

The toner preferably has a ratio (D4/D1) of the weight-average particle diameter (D4) to a number-average particle diameter (D1) of from 1.00 to 1.40. The closer to 1.00, the shaper the particle diameter distribution. A toner having such a small particle diameter and a sharp particle diameter distribution is uniformly charged, produces high-quality images with less foggy images and has high transferability.

Coulter Counter TA-II and Coulter Multisizer II from Beckman Coulter Inc. are used for measuring the particle diameter distribution as follows:

0.1 to 5 ml of a detergent, preferably alkylbenzene sulfonate is included as a dispersant in 100 to 150 ml of the electrolyte ISOTON R-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following channels are measured by the above-mentioned measurer using an aperture of 100 μm to determine a weight distribution and a number distribution:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

The toner preferably has a shape factor SF-1 of from 100 to 180, and a shape factor SF-2 of from 100 to 180.

Figure 12A:
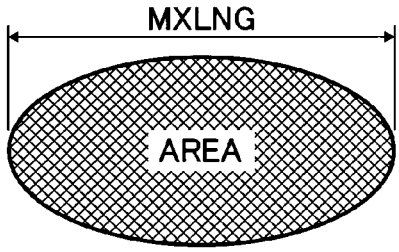
FIGS. 12A and 12B are schematic views each illustrating the shape of a toner for explaining SF-1 and SF-2 respectively.
Figure 12B:
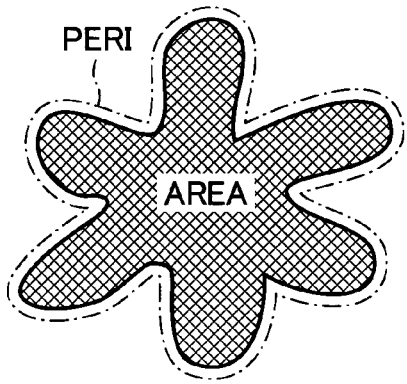

FIGS. 12A and 12B are schematic views each illustrating the shape of a toner for explaining SF-1 and SF-2 respectively. The shape factor SF-1 represents a degree of roundness of a toner, and is determined in accordance with the following formula (1)

$$SF\text{-}1=\{(MXLNG)^2/AREA\}\times(100\pi/4) \quad (1)$$

wherein MXLNG represents an absolute maximum length of a particle and AREA represents a projected area thereof.

When the SF-1 is 100, the toner has the shape of a complete sphere. As SF-1 becomes greater, the toner becomes more amorphous.

SF-2 represents the concavity and convexity of the shape of the toner, and specifically a square of a peripheral length of an image projected on a two-dimensional flat surface (PERI) is divided by an area of the image (AREA) and multiplied by 100 π/4 to determine SF-2 as the following formula (2) shows.

$$SF\text{-}2=\{(PERI)^2/AREA\}\times(100\pi/4) \quad (2)$$

When SF-2 is 100, the surface of the toner has less concavities and convexities. As SF-2 becomes greater, the concavities and convexities thereon become more noticeable.

The shape factors are measured by photographing the toner with a scanning electron microscope (S-800) from Hitachi, Ltd. and analyzing the photographed image of the toner with an image analyzer Luzex III from NIRECO Corp.

When the shape of a toner is close to a sphere, the toner contacts the other toner or a photoreceptor at a point. Therefore, the toners adhere less each other and have higher fluidity. In addition, the toner and the photoreceptor less adhere to each other, and transferability of the toner improves. When SF-1 or SF-2 is more than 180, the transferability thereof deteriorates.

The toner preferably used for the image forming apparatus of the present invention is formed by a crosslinking and/or an elongation reaction of a toner constituent liquid including at least polyester prepolymer having a functional group including a nitrogen atom, polyester, a colorant, a charge controlling agent and a release agent are dispersed in an organic solvent in an aqueous medium. Hereinafter, the toner constituents will be explained.

The polyester is formed by polycondensating a polyol compound and a polycarboxylic compound.

As the polyol (PO), diol (DIO) and triol (TO) can be used, and the DIO alone or a mixture of the DIO and a small amount of the TO is preferably used. Specific examples of the DIO include alkylene glycol such as ethylene glycol, 1,2-propylene glycol, 1,3-propylene glycol, 1,4-butanediol, and 1,6-hexanediol; alkylene ether glycol such as diethyleneglycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used. Specific examples of the TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarbonate (PC), dicarboxylic acid (DIC) and tricarboxylic acid (TC) can be used. The DIC alone, or a mixture of the DIC and a small amount of the TC are preferably used. Specific examples of the DIC include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the TC include aromatic polycarboxylic acids having 9 to 20 carbon atoms such as trimellitic acid and pyromellitic acid. PC can be formed from a reaction between the PO and the above-mentioned acids anhydride or lower alkyl ester such as methyl ester, ethyl ester and isopropyl ester.

The PO and PC are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1. The polycondensation reaction between the PO and PC is performed by heating the Po and PC at from 150 to 280° C. in the presence of a known esterification catalyst such as tetrabutoxytitanate and dibutyltinoxide and removing produced water while optionally depressurizing to prepare polyester having a hydroxyl group. The polyester preferably has a hydroxyl value not less than 5, and an acid value of from 1 to 30 and more preferably from 5 to 20. When the polyester has an acid value within the range, the resultant toner tends to be negatively charged to have good affinity with a recording paper and low-temperature fixability of the toner on the recording paper improves. However, when the acid value is greater than 30, the resultant toner is not stably charged and the stability becomes worse by environmental variations. The polyester preferably has a weight-average molecular weight of from 10,000 to 400,000, and more preferably form 20,000 to 200,000. When the weight-average molecular weight is less than 10,000, offset resistance of the resultant toner deteriorates. When greater than 400,000, low-temperature fixability thereof deteriorates.

The polyester preferably includes a urea-modified polyester besides an unmodified polyester formed by the above-mentioned polycondensation reaction. The urea-modified polyester is formed by reacting a polyisocyanate compound (PIC) with a carboxyl group or a hydroxyl group at the end of the polyester formed by the above-mentioned polycondensation reaction to form a polyester prepolymer (A) having an isocyanate group, and reacting amine with the polyester prepolymer (A) to crosslink and/or elongate a molecular chain thereof.

Specific examples of the PIC include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; aromatic diisocyanate such as tolylenedisocyanate and diphenylmethanediisocyanate; aroma aliphatic diisocyanate such as α,α,α',α'-tetramethylxylylenediisocyanate; isocyanurate; the above-mentioned polyisocyanate blocked with phenol derivatives, oxime and caprolactam; and their combinations.

The PIC is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When [NCO] has a molar ratio less than 1, a urea content in ester of the modified polyester decreases and hot offset resistance of the resultant toner deteriorates.

The polyester prepolymer (A) preferably includes a polyisocyanate group of from 0.5 to 40% by weight, more preferably from 1 to 30% by weight, and furthermore preferably from 2 to 20% by weight. When the content is less than 0.5% by weight, hot offset resistance of the resultant toner deteriorates, and in addition, the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) reacted with the polyester prepolymer (A) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoronediamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these amines (B), diamines (B1) and mixtures in which a diamine is mixed with a small amount of a polyamine (B2) are preferably used.

A mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2.

When the mixing ratio is greater than 2 or less than 1/2, molecular weight of the urea-modified polyester decreases, resulting in deterioration of hot offset resistance of the toner.

The urea-modified polyester may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner deteriorates.

The urea-modified polyester can be prepared by a method such as a one-shot method. The PO and PC are heated at from 150 to 280° C. in the presence of a known esterification catalyst such as tetrabutoxytitanate and dibutyltinoxide and removing produced water while optionally depressurizing to prepare polyester having a hydroxyl group. Next, the polyisocyanate is reacted with the polyester at from 40 to 140° C. to form a polyester prepolymer (A) having an isocyanate group. Further, the amines (B) are reacted with the (A) at from 0 to 140° C. to form a urea-modified polyester.

When the PIC, and (A) and (B) are reacted, a solvent may optionally be used. Specific examples of the solvents include inactive solvents with the PIC such as aromatic solvents such as toluene and xylene; ketones such as acetone, methyl ethyl ketone and methyl isobutyl ketone; esters such as ethyl acetate; amides such as dimethylformamide and dimethylacetamide; and ethers such as tetrahydrofuran.

A reaction terminator can optionally be used in the crosslinking and/or elongation reaction between the (A) and (B) to control a molecular weight of the resultant urea-modified polyester. Specific examples of the reaction terminators include monoamines such as diethylamine, dibutylamine, butylamine and laurylamine; and their blocked compounds such as ketimine compounds.

The weight-average molecular weight of the urea-modified polyester is not less than 10,000, preferably from 20,000 to 10,000,000 and more preferably from 30,000 to 1,000,000. When the weight-average molecular weight is less than 10,000, hot offset resistance of the resultant toner deteriorates. The number-average molecular weight of the urea-modified polyester is not particularly limited when the aftermentioned unmodified polyester resin is used in combination. Namely, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000 and more preferably from 2,000 to 8,000. When the number-average molecular weight is greater than 20,000, the low temperature fixability of the resultant toner deteriorates, and in addition the glossiness of full color images deteriorates.

A combination of the urea-modified polyester and the unmodified polyester improves low temperature fixability of the resultant toner and glossiness of color images produced thereby, and is more preferably used than using the urea-modified polyester alone. Further, the unmodified polyester may include modified polyester except for the urea-modified polyester.

It is preferable that the urea-modified polyester at least partially mixes with the unmodified polyester to improve the low temperature fixability and hot offset resistance of the resultant toner. Therefore, the urea-modified polyester preferably has a structure similar to that of the unmodified polyester.

A mixing ratio between the unmodified polyester and urea-modified polyester is from 20/80 to 95/5, preferably from 70/30 to 95/5, more preferably from 75/25 to 95/5, and even more preferably from 80/20 to 93/7. When the urea-modified polyester is less than 5%, the hot offset resistance deteriorates, and in addition, it is disadvantageous to have both high temperature preservability and low temperature fixability.

The binder resin including the unmodified polyester and urea-modified polyester preferably has a glass transition temperature (Tg) of from 45 to 65° C., and preferably from 45 to 60° C. When the glass transition temperature is less than 45° C., the high temperature preservability of the toner deteriorates. When higher than 65° C., the low temperature fixability deteriorates.

As the urea-modified polyester is likely to be present on a surface of the parent toner, the resultant toner has better heat resistance preservability than known polyester toners even though the glass transition temperature of the urea-modified polyester is low.

Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The toner particles preferably include the colorant in an amount of from 1 to 15% by weight, and more preferably from 3 to 10% by weight.

The colorant for use in the present invention can be used as a masterbacth pigment when combined with a resin. Specific examples of the resin for use in the masterbacth pigment or for use in combination with masterbacth pigment include the modified and unmodified polyester resins mentioned above; styrene polymers and substituted styrene polymers such as polystyrene, poly-p-chlorostyrene and polyvinyltoluene; or their copolymers with vinyl compounds; polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these materials, materials negatively charging a toner are preferably used.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

A wax for use in the toner of the present invention as a release agent has a low melting point of from 50 to 120° C. When such a wax is included in the toner, the wax is dispersed in the binder resin and serves as a release agent at a location between a fixing roller and the toner particles. Thereby, hot offset resistance can be improved without applying an oil to the fixing roller used. Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

These charge controlling agent and release agents can be dissolved and dispersed after kneaded upon application of heat together with a master batch pigment and a binder resin, and can be added when directly dissolved or dispersed in an organic solvent.

The toner particles are preferably mixed with an external additive to assist in improving the fluidity, developing property and charging ability of the toner particles. Suitable external additives include inorganic particulate materials. It is preferable for the inorganic particulate materials to have a primary particle diameter of from 5 nm to 2 μm, and more preferably from 5 nm to 500 nm. In addition, it is preferable that the specific surface area of such particulate inorganic materials measured by a BET method is from 20 to 500 $m^2/g$. The content of the external additive is preferably from 0.01 to 5% by weight, and more preferably from 0.01 to 2.0% by weight, based on total weight of the toner composition.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. Among these particulate inorganic materials, a combination of a hydrophobic silica and a hydrophobic titanium oxide is preferably used. In particular, when a hydrophobic silica and a hydrophobic titanium oxide each having an average particle diameter not greater than 50 nm are used as an external additive, the electrostatic force and van der Waals' force between the external additive and the toner particles are improved, and thereby the resultant toner composition has a proper charge quantity. In addition, even when the toner composition is agitated in a developing device, the external additive is hardly released from the toner particles, and thereby image defects such as white spots and image omissions are hardly produced. Further, the quantity of particles of the toner composition remaining on image bearing members can be reduced.

When particulate titanium oxides are used as an external additive, the resultant toner composition can stably produce toner images having a proper image density even when environmental conditions are changed. However, the charge rising properties of the resultant toner tend to deteriorate. Therefore the addition quantity of a particulate titanium oxide is preferably smaller than that of a particulate silica, and in addition the total addition amount thereof is preferably from 0.3 to 1.5% by weight based on weight of the toner particles not to deteriorate the charge rising properties and to stably produce good images.

Next, a method of preparing the toner will be explained, but is not limited thereto.

1) Dispersing a colorant, an unmodified polyester, a polyester prepolymer having an isocyanate group and a wax in an organic solvent to prepare a toner constituents liquid.

The organic solvent is preferably volatile, having a boiling point less than 100° C. because of being easily removed after parent toner particles are formed. Specific examples of the organic solvent include toluene, xylene, benzene, carbon tetrachloride, methylenechloride, 1,2-dichloroethane, 1,1,2-trichloroethane, trichloroethylene, chloroform, monochlorobenzene, dichloroethylidene, methylacetate, ethylacetate, methyl ethyl ketone, methylisobutylketone, etc. These can be used alone or in combination. Particularly, aromatic solvents such as toluene and xylene and halogenated hydrocarbons such as methylenechloride, 1,2-dichloroethane, chloroform and carbon tetrachloride are preferably used. The toner constituents liquid preferably includes an organic solvent in an amount of from 0 to 300 parts by weight, more preferably from 0 to 100 parts by weight, and furthermore preferably from 25 to 70 parts by weight per 100 parts by weight of the prepolymer.

(2) Emulsifying the toner constituents liquid in an aqueous medium under the presence of a surfactant and a particulate resin. The aqueous medium may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

The toner constituents liquid preferably includes the aqueous medium is typically from 50 to 2,000 parts by weight, and preferably from 100 to 1,000 parts by weight. When less than 50 parts by weight, the toner constituents liquid is not well dispersed and toner particles having a predetermined particle diameter cannot be formed. When greater than 2,000 parts by weight, the production cost increases.

A dispersant such as a surfactant or an organic particulate resin is optionally included in the aqueous medium to improve the dispersion therein.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium-{omega-fluoroalkanoyl(C6-C8)-N-ethylamino}-1-propane sulfonate, fluoroalkyl(C11-C20) carboxylic acids and their metal salts, perfluoroalkylcarboxylic acids and their metal salts, perfluoroalkyl(C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, monoperfluoroalkyl(C6-C16) ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOPEF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of cationic surfactants, which can disperse an oil phase including toner constituents in water, include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SURFLONS-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

The particulate resin is included to stabilize a parent toner particles formed in the aqueous medium. Therefore, the particulate resin is preferably included so as to have a coverage of from 10 to 90% over a surface of the toner particle. Specific examples of the particulate resins include particulate polymethylmethacrylate having a particle diameter of 1 μm and 3 μm, particulate polystyrene having a particle diameter of 0.5 μm and 2 μm and a particulate polystyrene-acrylonitrile having a particle diameter of 1 μm. These are marketed as PB-200 from Kao Corporation, SGP from Soken Chemical & Engineering Co., Ltd., Technopolymer SB from Sekisui Plastics Co., Ltd., SGP-3G from Soken Chemical & Engineering Co., Ltd. and Micro Pearl from Sekisui Chemical Co., Ltd.

In addition, inorganic dispersants such as tricalcium phosphate, calcium carbonate, titanium oxide, colloidal silica and hydroxy apatite can also be used.

As dispersants which can be used in combination with the above-mentioned particulate resin and inorganic dispersants, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. At this point, the particle diameter (2 to 20 μm) means a particle diameter of particles including a liquid). When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C.

3) While an emulsion is prepared, amines (B) are included therein to be reacted with the polyester prepolymer (A) having an isocyanate group.

This reaction is accompanied by a crosslinking and/or a elongation of a molecular chain. The reaction time depends on reactivity of an isocyanate structure of the prepolymer (A) and amines (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

4) After the reaction is terminated, an organic solvent is removed from an emulsified dispersion (a reactant), which is washed and dried to form a parent toner particle.

The prepared emulsified dispersion (reactant) is gradually heated while stirred in a laminar flow, and an organic solvent is removed from the dispersion after stirred strongly when the dispersion has a specific temperature to form a parent toner particle having the shape of a spindle. When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis.

5) A charge controlling agent is beat in the parent toner particle, and inorganic particulate materials such as particulate silica and particulate titanium oxide are externally added thereto to form a toner.

Known methods using a mixer, etc. are used to beat in the charge controlling agent and to externally add the inorganic particulate materials.

Thus, a toner having a small particle diameter and a sharp particle diameter distribution can be obtained. Further, the strong agitation in the process of removing the organic solvent can control the shape of a toner from a sphere to a rugby ball, and the surface morphology thereof from being smooth to a pickled plum.

This application claims priority and contains subject matter related to Japanese Patent Application No. 2007-043421 filed on Feb. 23, 2007, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image developer, comprising:

a rotatable developer bearer;

a rotatable developer feeding member contacting the developer bearer;

a developer container located above the developer feeding member, wherein the developer container comprises:

a pressure reducing member configured to reduce a pressure applied to the developer feeding member, and a first stirring bar located directly below the pressure reducing member and configured to stir a developer such that a gap between an end of the pressure reducing member and an outer diameter of the stirring bar is 6 mm;

the first stirring bar has a shape widening toward a downstream side thereof in the rotating direction, and the first stirring bar has plural cylinders having a gap not less than 2 mm between each cylinder in a longitudinal direction.

2. The image developer of claim 1, further comprising a doctor blade configured to regulate an amount of the developer on the developer bearer, wherein the first stirring bar rotates in the forward direction of a flow of the toner scraped by the doctor blade.

3. A process cartridge detachable from an image forming apparatus, comprising an image bearer configured to bear an image; and an image developer configured to develop a latent image on the image bearer with a developer comprising a toner, wherein the image developer is the image developer according to claim 1.

4. The process cartridge of claim 3, wherein the image developer comprises a doctor blade configured to regulate an amount of the developer on the developer bearer, wherein the first stirring bar rotates in the forward direction of a flow of the toner scraped by the doctor blade.

5. An image forming apparatus, comprising the process cartridge according to claim 3.

6. The image forming apparatus of claim 5, wherein the toner has a volume-average particle diameter of from 3 to 8 μm and a ratio (Dv/Dn) of the volume-average particle diameter (Dv) to a number-average particle diameter (Dn) thereof of from 1.00 to 1.40.

7. The image forming apparatus of claim 5, wherein the toner has a shape factor SF-1 of from 100 to 180 and a shape factor SF-2 of from 100 to 180.

8. The image forming apparatus of claim 5, wherein the toner is prepared by a method comprising:

dispersing at least a polyester prepolymer having a functional group including a nitrogen atom, a polyester resin, a colorant and a release agent in an organic solvent to prepare a toner constituents solution; and crosslinking or elongating the toner constituents solution in an aqueous medium.

9. An image developer, comprising:

a rotatable developer bearer;

a rotatable developer feeding member contacting the developer bearer;

a developer container located above the developer feeding member, wherein the developer container comprises:

a pressure reducing member configured to reduce a pressure applied to the developer feeding member, a first stirring bar located directly below the pressure reducing member and configured to stir a developer such that a gap between an end of the pressure reducing member and an outer diameter of the stirring bar is 6 mm, and a second stirring bar configured to stir the developer, wherein the second stirring bar has a shape widening toward a downstream side thereof in the rotating direction.

10. The image developer of claim 9, further comprising a doctor blade configured to regulate an amount of the developer on the developer bearer, wherein the first stirring bar rotates in the forward direction of a flow of the toner scraped by the doctor blade.

11. The image developer of claim 9, wherein the second stirring bar has plural cylinders having a gap not less than 2 mm between each cylinder in a longitudinal direction.

12. A process cartridge detachable from an image forming apparatus, comprising an image bearer configured to bear an image; and an image developer configured to develop a latent image on the image bearer with a developer comprising a toner, wherein the image developer is the image developer according to claim 9.

13. The process cartridge of claim 12, wherein the image developer comprises a doctor blade configured to regulate an amount of the developer on the developer bearer, wherein the first stirring bar rotates in the forward direction of a flow of the toner scraped by the doctor blade.

14. An image forming apparatus, comprising the process cartridge according to claim 12.

15. The image forming apparatus of claim 14, wherein the toner has a volume-average particle diameter of from 3 to 8 μm and a ratio (Dv/Dn) of the volume-average particle diameter (Dv) to a number-average particle diameter (Dn) thereof of from 1.00 to 1.40.

16. The image forming apparatus of claim 14, wherein the toner has a shape factor SF-1 of from 100 to 180 and a shape factor SF-2 of from 100 to 180.

17. The image forming apparatus of claim 14 wherein the toner is prepared by a method comprising:

dispersing at least a polyester prepolymer having a functional group including a nitrogen atom, a polyester resin, a colorant and a release agent in an organic solvent to prepare a toner constituents solution; and crosslinking or elongating the toner constituents solution in an aqueous medium.

* * * * *